US010689771B2

(12) United States Patent
Dufresne

(10) Patent No.: US 10,689,771 B2
(45) Date of Patent: Jun. 23, 2020

(54) CONFIGURATIONS AND POSITIONING OF CONTACT BAR SEGMENTS ON A CAPPING BOARD FOR ENHANCED CURRENT DENSITY HOMOGENEITY AND/OR SHORT CIRCUIT REDUCTION

(71) Applicant: PULTRUSION TECHNIQUE INC., St-Bruno (CA)

(72) Inventor: Robert P. Dufresne, Saint-Bruno (CA)

(73) Assignee: Pultrusion Technique, Inc., Saint-Bruno, Quebec (CA)

( * ) Notice: Subject to any disclaimer, the term of this patent is extended or adjusted under 35 U.S.C. 154(b) by 584 days.

(21) Appl. No.: 14/895,051

(22) PCT Filed: Jun. 4, 2014

(86) PCT No.: PCT/CA2014/050514
§ 371 (c)(1),
(2) Date: Dec. 1, 2015

(87) PCT Pub. No.: WO2014/194421
PCT Pub. Date: Dec. 11, 2014

(65) Prior Publication Data

US 2016/0115607 A1 Apr. 28, 2016

Related U.S. Application Data

(60) Provisional application No. 61/830,826, filed on Jun. 4, 2013.

(51) Int. Cl.
*C25C 7/00* (2006.01)
*C25C 1/00* (2006.01)

(52) U.S. Cl.
CPC . *C25C 7/00* (2013.01); *C25C 1/00* (2013.01)

(58) Field of Classification Search
CPC ..... C25C 7/00–7/08
See application file for complete search history.

(56) References Cited

U.S. PATENT DOCUMENTS 3,697,404 A 10/1972 Paige
6,342,136 B1 1/2002 Virtanen et al.
(Continued)

FOREIGN PATENT DOCUMENTS

CA 1201681 3/1986
CA 2831626 A1 * 10/2012 ..... C25C 7/00
(Continued)

OTHER PUBLICATIONS

International Search Report (ISR) (PCT Form PCT/ISA/210) dated Aug. 4, 2014, in PCT/CA2014/050514.
(Continued)

*Primary Examiner* — Alexander W Keeling
(74) *Attorney, Agent, or Firm* — BakerHostetler

(57) ABSTRACT

Techniques for installing contact bar segments in an electrolytic cell can include positioning a series of contact bar segments on a capping board to provide enhanced current density distribution in the series of contact bar segments positioned along the capping board, the contact bar segments including at least three contact regions for anodes and cathodes. In some scenarios, sub-sets of contact bar segments may be provided, such that one sub-set is configured to contact N number of anodes and N number of cathodes; another sub-set is configured to contact N number of anodes and N+1 number of cathodes including one center segment; and a further sub-set configured to contact N+1 number of anodes and N number of cathodes including two end segments.

10 Claims, 12 Drawing Sheets

(56) References Cited

U.S. PATENT DOCUMENTS

| | | | | |
|---|---|---|---|---|
| 8,123,917 | B2 * | 2/2012 | Dufresne | C25C 7/02<br>204/279 |
| 8,147,662 | B2 | 4/2012 | Dufresne | |
| 8,308,920 | B2 | 11/2012 | Ashford et al. | |
| 2012/0160700 | A1 * | 6/2012 | Wiedmeyer | C25C 3/34<br>205/477 |

FOREIGN PATENT DOCUMENTS

| | | | |
|---|---|---|---|
| GB | 1 434 334 | | 5/1976 |
| WO | 2008/101345 | | 8/2008 |
| WO | 2012/087398 | A1 | 6/2012 |
| WO | 2012/129700 | A1 | 10/2012 |
| WO | 2013/006977 | | 1/2013 |

OTHER PUBLICATIONS

European Search Report issued in European Patent Application No. 14807502.1 dated May 10, 2016.

* cited by examiner

CONFIGURATIONS AND POSITIONING OF CONTACT BAR SEGMENTS ON A CAPPING BOARD FOR ENHANCED CURRENT DENSITY HOMOGENEITY AND/OR SHORT CIRCUIT REDUCTION

REFERENCE TO RELATED APPLICATIONS

This application is the U.S. national stage of International Application No. PCT/CA2014/05051, filed Jun. 4, 2014, which claims the priority of U.S. Provisional Application No. 61/830,826, filed Jun. 4, 2013, the disclosures of which are all incorporated herein by reference in their entireties.

BACKGROUND

In the hydrometallurgical industry, it is of common practice to refine metal by electrolysis in electrolytic cells especially designed for this purpose. The metals to be refined are usually conventional metals such as copper, zinc, nickel or cadmium, or precious metals such as silver, platinum or gold, and others.

It is also of common practice to use metal plates as anodes or cathodes or both. These metal plates often weight several hundred pounds. Usually, the metal to be refined, or the metal used to carry the electric current, is in the form of plates of a given thickness, which are provided at their upper end with two laterally extending projections, called hanging legs. Such projections facilitate gripping, handling and hanging of the plates on lateral sidewalls of the cells. These projections also serve to electrically contact or insulate the electrode.

In use, the electrode plates which, as mentioned, can each weigh several hundred pounds, are immersed into the cells in parallel relationship and are used as anodes, cathodes or both, depending on the affinity of the metal being refined.

In order to have the electrodes positioned in a precise desired location, it is of common practice to place a component called a "capping board" or a "bus bar insulator" onto the top surface of each lateral sidewall of the cells. These capping boards are used to position the plates with respect to each other. They are also used as electric insulators between adjacent cells and/or the electrodes and/or the ground.

In practice, the capping boards are used not only as supports to position the electrodes, but also as supports to avoid damage to the masonry, concrete or polymer-concrete forming the lateral side walls of the cells during the insertion and removal of the heaving electrodes. They are also used for electrolytic refining and electro-winning of metals.

Capping boards are further used in combination with electrically conductive "contact bars", the purpose of which is to allow electrical connection between the ends of the anodes and cathodes located in adjacent cells. Thus, the combined use of capping boards and contact bars allows both insulation and distribution of electric current.

To achieve proper electrical contact with the contact bar, the plates forming the electrodes are provided with support hanging legs externally projecting on their opposite upper ends. Only one end of the legs of each plate is in contact with a contact bar on one side of the cell where it is located. The other leg of the same plate is held onto the capping board located on the opposite side of the cell in such a way as to be electrically insulated. Thus, the capping board per se plays the role of an insulator and is thus made of insulating material. The contact bar usually extends over the full length of the corresponding capping board in order to connect altogether all the anodes of one cell to all the cathodes of the adjacent cell and vice versa. The contact bar may interconnect all of the cathodes to the anodes on other adjacent cells or perform other electric connection function between electrodes as desired.

Additionally, capping boards may be designed to receive one or more contact bars arranged in a parallel relationship. For example, a capping board may be provided with a primary contact bar and a secondary contact. The primary contact bar may contact anodes and the secondary contact bar may contact cathodes, or vice-versa. Electrolytic cells including three or more contact bars may also be used in electrolytic refinery of metals, such as described in patent documents U.S. Pat. Nos. 8,308,920, 6,342,136 and CA 1.201.681.

In hydrometallurgical refining of metals, during recovery of the metal (such as copper), some of the cathodes are removed from the corresponding contact bar to recover the metal that has accumulated thereon. So as to keep the electrolytic cell refining the metal, one cathode over three cathodes are usually removed from the contact bar (more rarely, one cathode over two are removed from the contact bar). The removal of a portion of the cathodes from the contact bar may cause electric short-circuits. Short-circuits may also be caused by many other factors, such that some major metal refineries may suffer from about 5,000 short-circuits per day.

So far, it has been of common practice to use contact bars made as a one piece structure extending over the full length of the electrolytic cell. However, advantageously the contact bar may be segmented into a plurality of contact bar segments as disclosed in U.S. 61/751,501. The contact bar segments may have various configurations and numbers of contact with cathodes and anodes.

There is a need for improved solutions enabling improved current density distribution along the length of the electrolytic cell and reduction of the short-circuit risks during metal refining and recovery.

SUMMARY OF THE INVENTION

Embodiments of the present invention provide a method and related capping board and contact bar segment assembly configuration for reducing electric short-circuits and/or increasing current distribution or homogeneity during regular refining and during recovery of the metal from cathodes.

There is provided a method including:

providing a capping board;

providing a series of contact bar segments positionable on the capping board for providing alternating contact points for a pre-determined number of anodes and a pre-determined number of cathodes, wherein the series of contact bar segments includes:

a first sub-set of contact bar segments each being sized and configured to contact N number of anodes and N number of cathodes; and a second sub-set of one or more contact bar segments each being sized and configured to contact N number of anodes and N+1 number of cathodes, wherein the second sub-set of the one or more contact bar segments include:

a center contact bar segment that is positionable at the center of the capping board.

In an optional aspect, the series of contact bar segments may include a third sub-set of one or more contact bar segments, each being sized and configured to contact N+1 number of anodes and N number of cathodes, wherein the third sub-set of the one or more contact bar segments include two end contact bar segments that are positionable at respective opposed extremities of the capping board.

In some other aspects, the method further includes positioning the first sub-set of contact bar segments on the capping board and contacting the pre-determined number of anodes and cathodes with the contact bar segments.

In some aspects, the number N in the first and second sub-sets of contact bar segments may be three.

In some aspects, there is provided an assembly comprising:

a capping board;

a series of contact bar segments positionable on the capping board for providing alternating contact points for a pre-determined number of anodes and a pre-determined number of anodes cathodes, wherein the series of contact bar segments comprises:

a first sub-set of contact bar segments each being sized and configured to contact N number of anodes and N number of cathodes; and a second sub-set of one or more contact bar segments each being sized and configured to contact N number of anodes and N+1 number of cathodes, wherein the second sub-set of the one or more contact bar segments include:

a center contact bar segment that is positionable at the center of the capping board.

In an optional aspect, the series of contact bar segments of the assembly may include a third sub-set of one or more contact bar segments, each being sized and configured to contact N+1 number of anodes and N number of cathodes, wherein the third sub-set of the one or more contact bar segments include two end contact bar segments that are positionable at respective opposed extremities of the capping board.

In an optional aspect, there is provided a method including positioning a series of contact bar segments on a capping board to provide enhanced current density distribution in the series of contact bar segments positioned along the capping board, the contact bar segments including at least three contact regions for anodes and cathodes.

In another optional aspect, the method may include varying the size and configuration of the contact bar segments along the capping board. Optionally, the method may include positioning contact bar segment with increased number of contact regions for anodes on a middle section of the capping board. Further optionally, the method may also include positioning contact bar segment with increased number of contact regions for anodes on both opposite end sections of the capping board to enhance amperage homogeneity.

In another optional aspect, the method may include increasing or maximizing the number of contact bar segments including three contact regions for anodes and three contact regions for cathodes according to the total number of cathodes to be placed on the capping board.

In another optional aspect, the method may also include positioning the contact bar segments on the capping board with a symmetrical configuration with respect to a middle of the capping board.

In some aspects, there is provided a method including:

providing a capping board;

providing a series of contact bar segments positionable on the capping board for providing alternating contact points for a pre-determined number of anodes and a pre-determined number of cathodes, wherein the series of contact bar segments includes:

a first sub-set of contact bar segments each being sized and configured to contact N number of anodes and N number of cathodes; and a second sub-set of one or more contact bar segments each being sized and configured to contact N+1 number of anodes and N number of cathodes, wherein the second sub-set of the one or more contact bar segments includes a center contact bar segment that is positionable at the center of the capping board.

In some aspects, two of the first sub-set of contact bar segments are end contact bar segments that are positionable at respective opposed extremities of the capping board.

In some aspects, the method includes positioning the first sub-set of contact bar segments on the capping board and contacting the pre-determined number of anodes and cathodes with the contact bar segments.

In some aspects, the number N in the first and second sub-sets of contact bar segments is three.

In some aspects, the method includes varying the size and configuration of the contact bar segments along the capping board.

In some aspects, there is provided an assembly comprising:

a capping board;

a series of contact bar segments positionable on the capping board for providing alternating contact points for a pre-determined number of anodes and a pre-determined number of anodes cathodes, wherein the series of contact bar segments comprises:

a first sub-set of contact bar segments each being sized and configured to contact N number of anodes and N number of cathodes; and a second sub-set of one or more contact bar segments each being sized and configured to contact N+1 number of anodes and N number of cathodes, wherein the second sub-set of the one or more contact bar segments includes a center contact bar segment that is positionable at the center of the capping board.

In some aspects, two of the first sub-set of contact bar segments are end contact bar segments that are positionable at respective opposed extremities of the capping board.

In some aspects, the number N in the first and second sub-sets of contact bar segments is three.

In some aspects, the assemblies and methods above can have one or more additional features described and/or illustrated herein.

DETAILED DESCRIPTION OF THE INVENTION

The present invention provides a method and related capping board and contact bar segment assembly configuration for reducing electric short-circuits during refining or electro-plating in electrorefinery or electrowinning of metals and during recovery of the metal from cathodes.

Embodiments of the method may also contribute to enhance current distribution uniformity or regularity along the length of the contact bar segment assembly.

Figure 1:
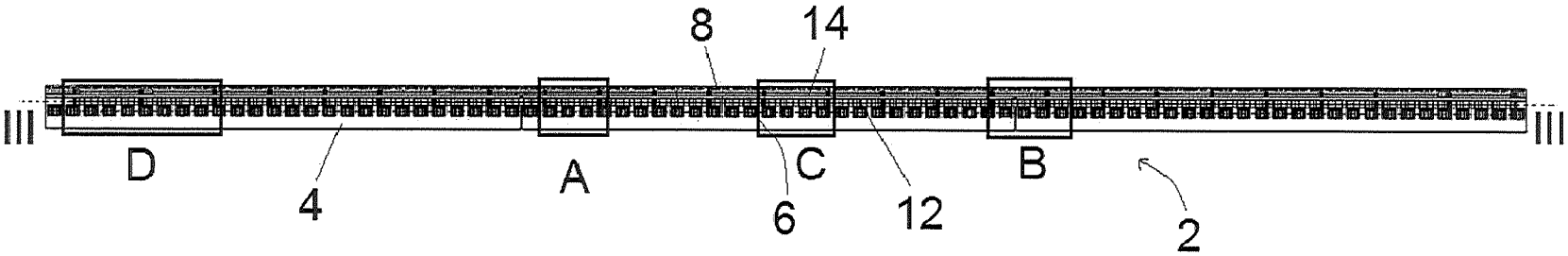
FIG. 1 is a top plan view of a capping board and contact bar segment assembly according to an embodiment of the present invention.

Referring to FIG. 1, the capping board 2 has a main elongated body 4 and includes a first row of seats 6 and a second row of protrusions 8 extending upwardly from the main elongated body 4. Each of the seats 6 provides support for one of the electrodes by allowing the end of a hanging bar to sit on its upper surface (hanging bars not shown in FIG. 1). Each of the protrusions 8 provides lateral support for a contact bar which rests on the capping board. Each protrusion 8 may be a support wall and adjacent support walls may be spaced apart to enable sulfuric acid and water to be released during operation of the electrolytic cell. The size and configuration of the seats of the first row may differ from the size and configuration of the protrusions of the opposed second row, but it should be understood that the seats of the first row and the protrusions of the second row may be similar.

Figure 2:
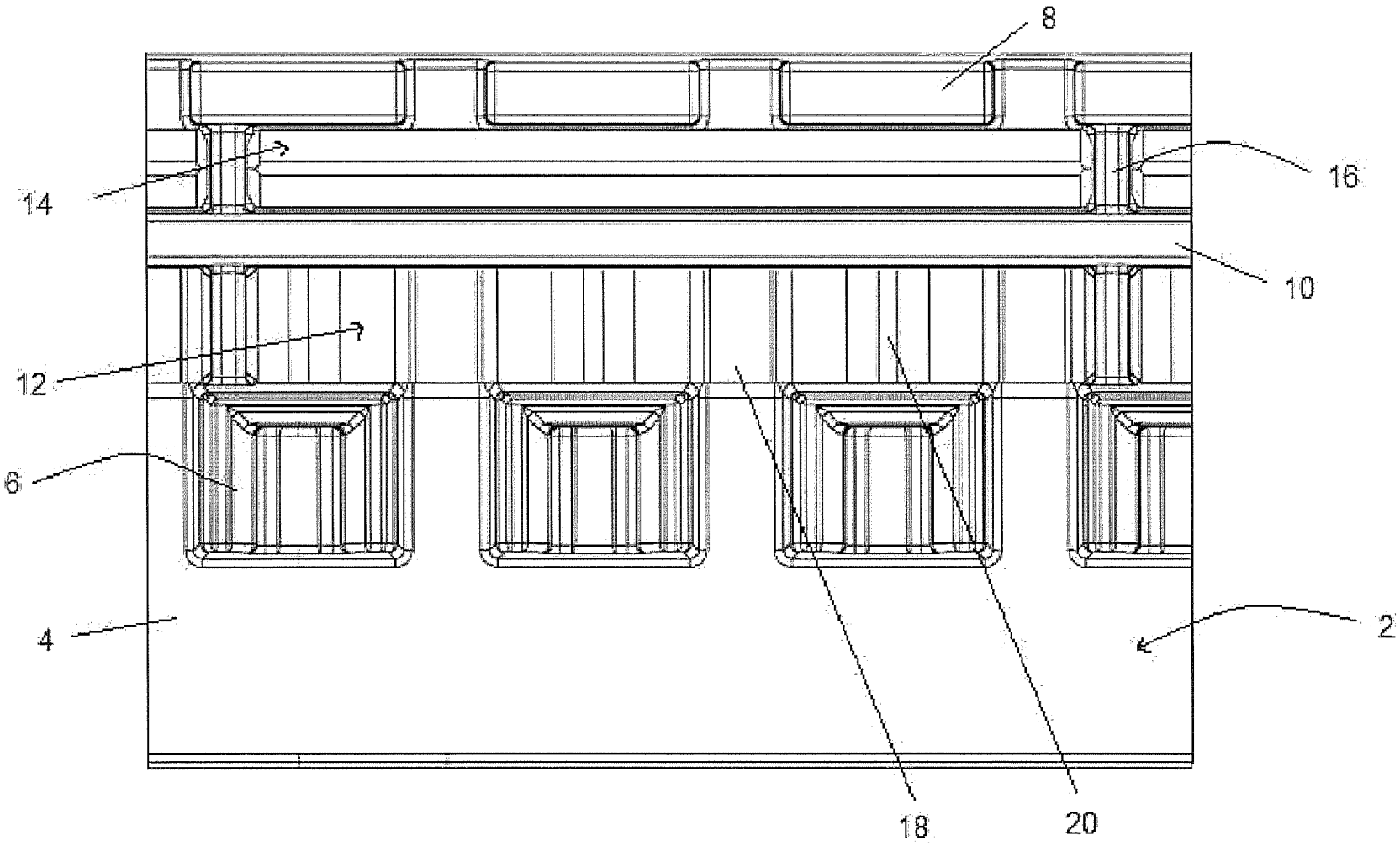
FIG. 2 is a top plan view of area A of FIG. 1.

Referring to FIG. 2, the first row of seats 6 and second row of protrusions 8 may be symmetrically opposed to each other along the main elongated body 4 and spaced apart from each other so as to define a central elongated channel. The capping board 2 may further include a dividing wall 10 for dividing the central elongated channel into a primary channel for receiving a plurality of adjacent primary contact bar segments 12 and a secondary channel for receiving a plurality of adjacent secondary contact bar segments 14. The capping board 2 may also include transverse walls 16 projecting from the central elongated channel so as to insulate the contact bar segments from one another.

It should be understood that the primary channel and secondary channel may be spaced apart from each other in such a way so as to ensure electrical insulation between the primary and secondary contact bars, without the presence of an additional dividing wall. It should be understood that the capping board may include as many transverse walls as needed according to the number of contact bar segments resting on the central elongated channel. It should also be noted that the central channel may be configured to receive a single row of contact bar segments. In addition, the row of contact bar segments arranged along the length of the capping board may be called a contact bar row.

Still referring to FIG. 2, two adjacent seats 6 or protrusions 8 of a same row may be spaced apart from each other so as to define a lateral channel which is sized to receive a corresponding hanging bar of an anode, such that the hanging bars reach and rest on the corresponding contact bars through the respective lateral channels. The upper region of the primary contact bar 12 may have a corrugated surface so as to include a first set of depressions 18 and a second set of depressions 20.

Figure 3:
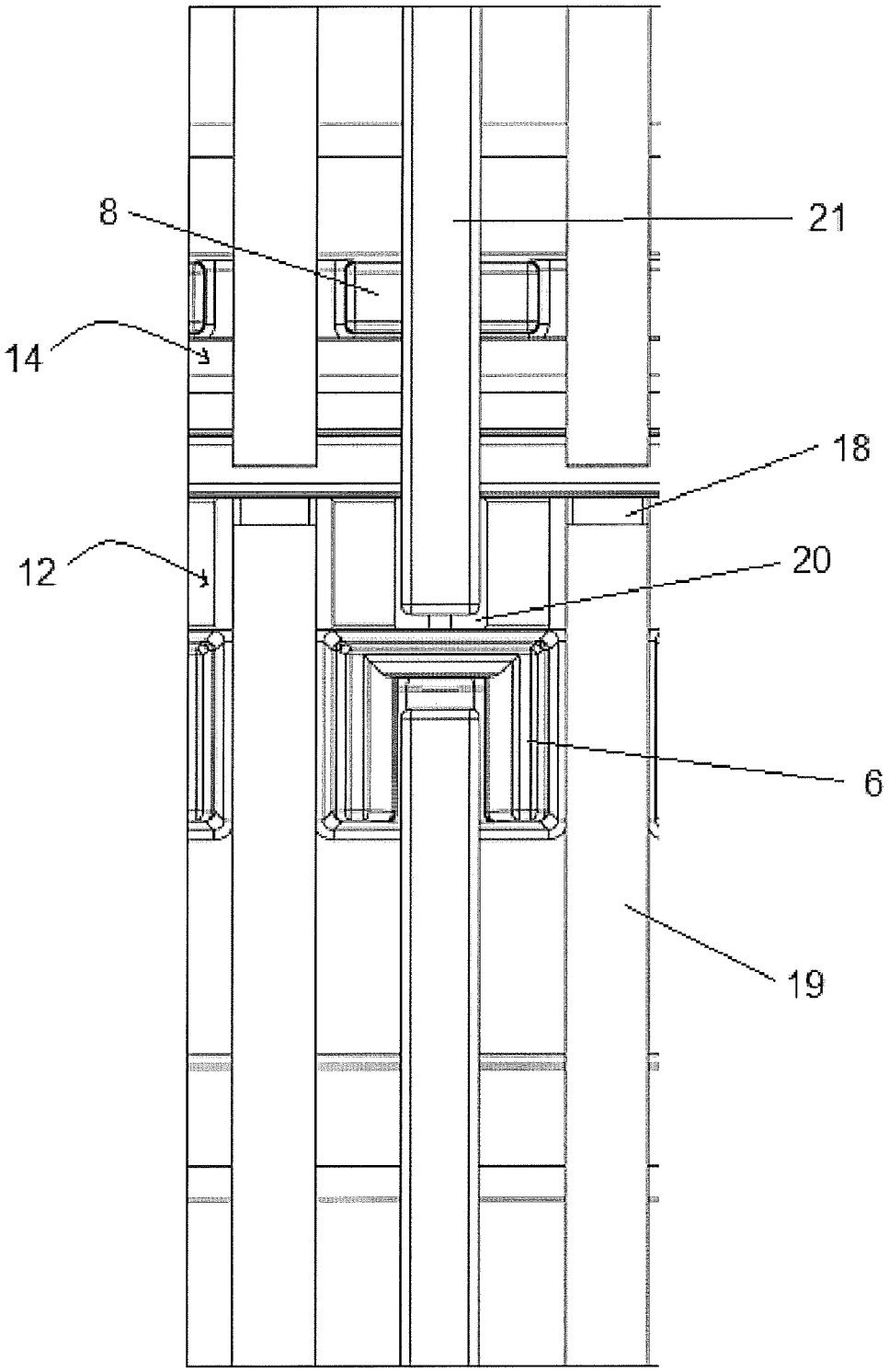
FIG. 3 is a top plan view of a portion of a capping board and primary/secondary contact bar segments with hanging bars of cathodes and anodes according to an optional embodiment of the present invention.

Referring to FIG. 3, the first set of depressions 18 may be sized and shaped to be in contact with the hanging bar 19 of the anodes. The second set of depressions 20 may be sized and shaped to receive the hanging bars 21 of the cathodes so as to avoid potential short circuits of the secondary contact bar of the anodes. The first and second series of depressions 18, 20 may be sized and shaped differently with respect to each other. However, it should be understood that all the depressions of the primary contact 12 bar may be the same. The secondary contact bar 14 may have a triangular cross-section and may be contacted by the hanging bars of the cathodes. Alternatively, the secondary contact bar may have various other sizes and shapes known for refining metals.

In an electrolytic cell, there is typically an extra anode relative to the number of cathodes. The number of cathodes may vary from one electrolytic cell to another depending on the chosen length of the electrolytic cell for example. During recovery of copper, for example, one cathode out of three is generally removed from the electrolytic cell to collect copper that has deposited thereon. Electric short-circuits may occur while some cathodes are removed from the cell.

According to an embodiment of the present invention, there is provided a method to configure and place contact bar segments on the capping board so as to enhance the regulation of the electric current density distribution and/or reduce short circuits along the contact bar row that is composed of multiple contact bar segments.

Depending on the overall number of cathodes and anodes, some contact bar segments may include three contact regions for anodes and three contact regions for cathodes; other contact bar segments may include four contact regions for anodes and four contact regions for cathodes; and still other contact bar segments may include four contact regions for cathodes and three contact regions for anodes. In an optional aspect, the method may include increasing or maximizing the number of contact bar segments including three contact regions for anodes and three contact regions for cathodes to enhance amperage homogeneity along the row of contact bar segments. In another optional aspect, the contact bar segments including four contact regions for cathodes and three contacts region for anodes may be placed in a middle section or on an end section of the capping board.

Figure 4:
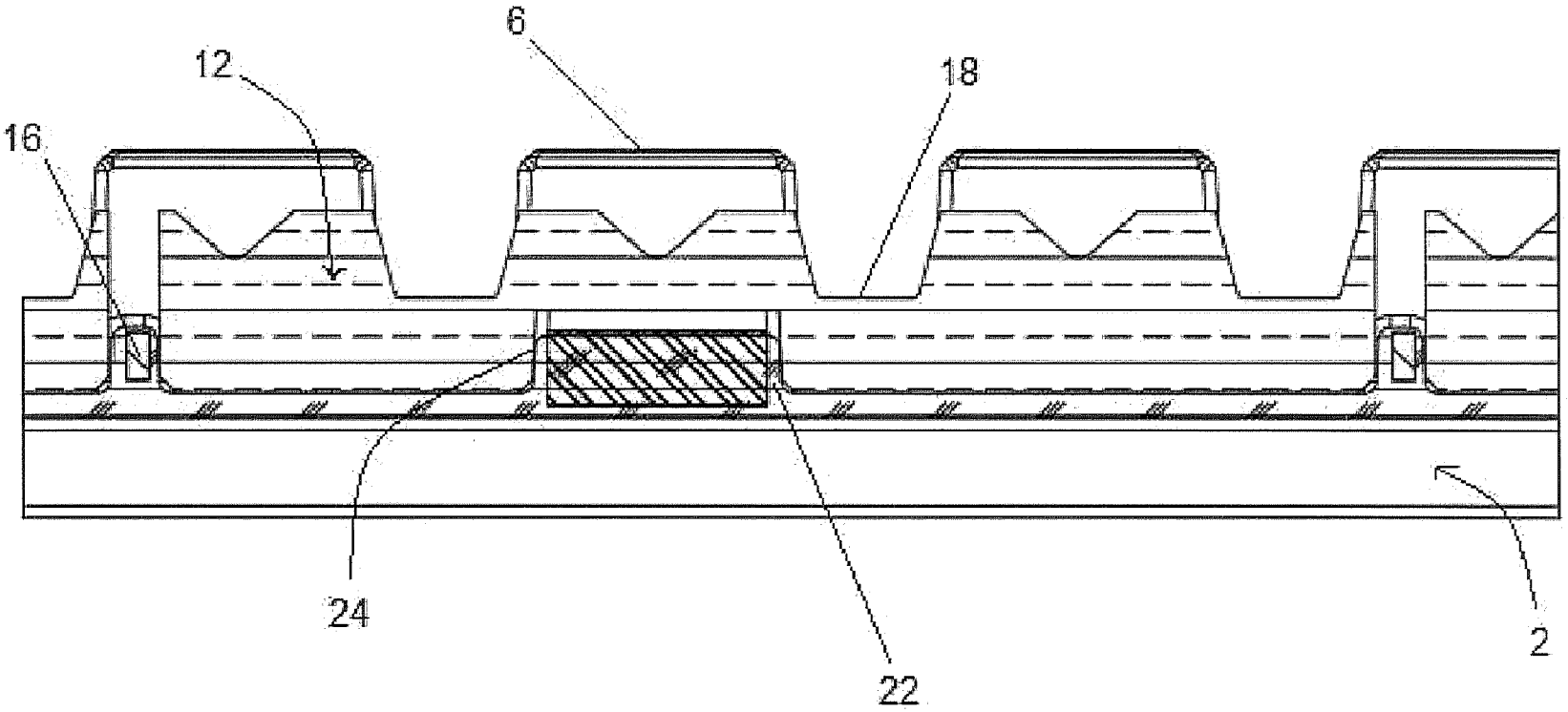
FIG. 4 is a cross-sectional side view of the capping board and primary contact bar segment of area A along line III of FIG. 1.
Figure 5:
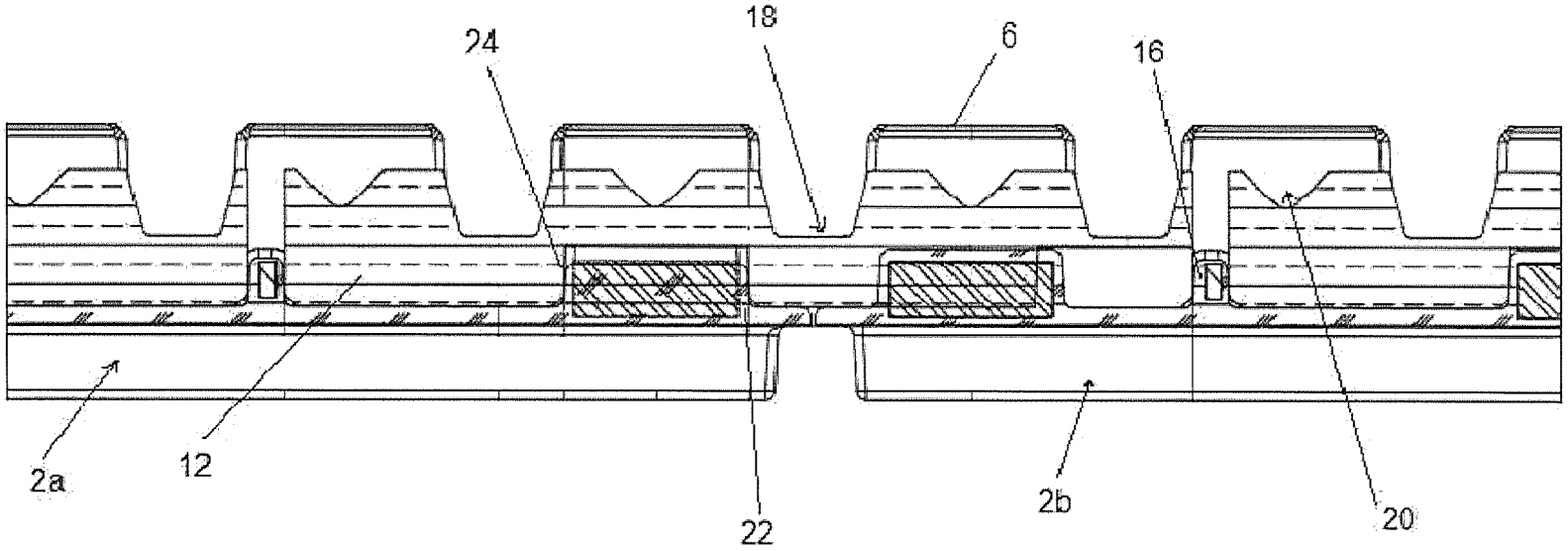
FIG. 5 is a cross-sectional side view of the capping board and primary contact bar segment of area B along line III of FIG. 1.

Referring to FIGS. 4 and 5, the capping board and contact bar assembly may include contact bar segments with three contact regions for anodes and three contact regions for the cathodes. In an optional aspect, the method of placement may maximize the number of primary contact bar segments according to FIG. 4 to favour capping board segments with three contact regions 18 for anodes (on the primary contact bar segment) and three contact regions for cathodes (on the secondary contact bar segment, not shown in FIG. 4), thereby enhancing amperage uniformity all along the cell during metal plating and from one cell to another cell, and while removing one cathode out of three during copper recovery.

Figure 6:
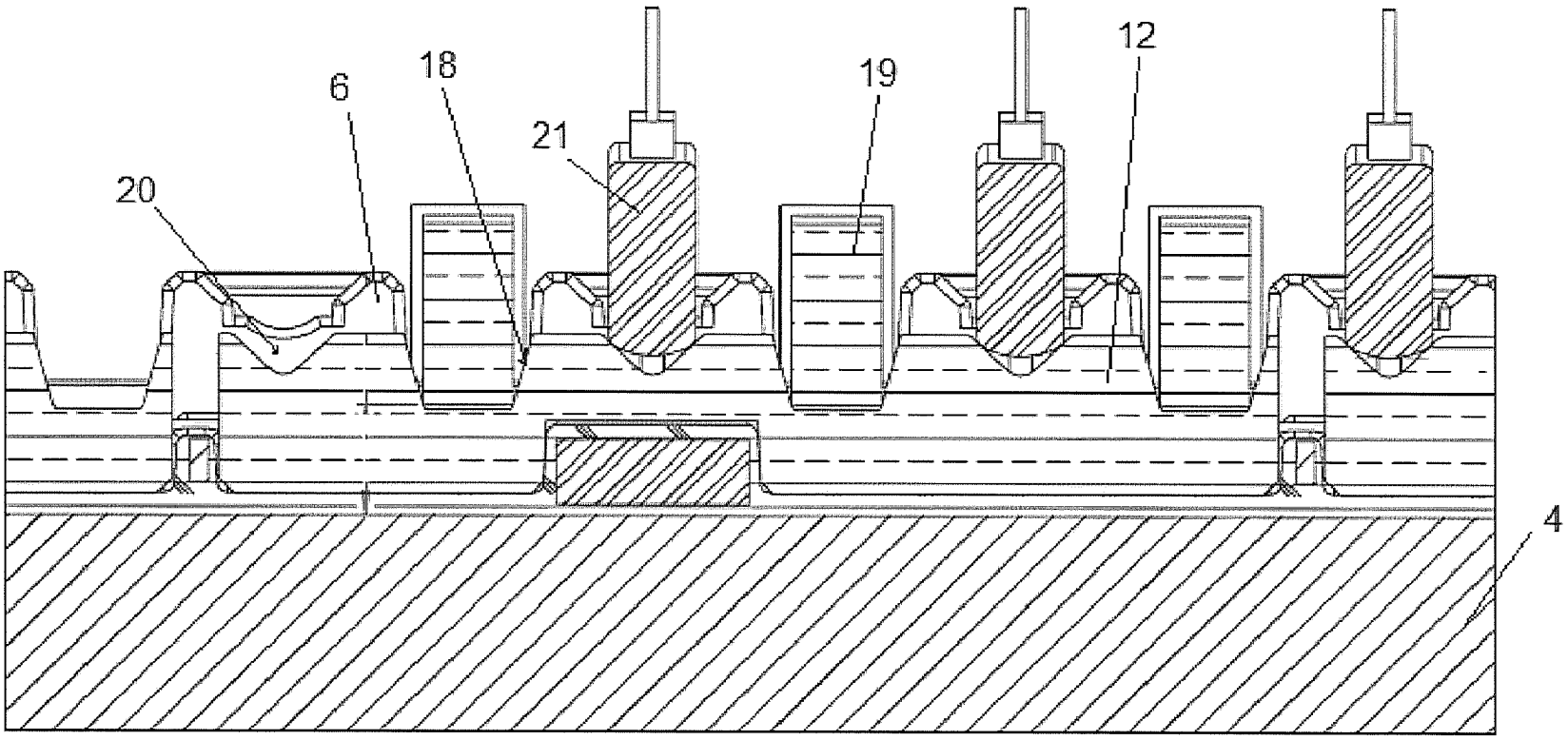
FIG. 6 is a cross-sectional side view of a capping board and primary contact bar segment with hanging bars of cathodes and anodes according to an optional embodiment of the present invention.

FIG. 6 illustrates a contact bar segment having three contact regions for hanging bars of the anodes and three contact regions for hanging bars of the cathodes. One cathode and one anode have been removed from the contact bar segment in FIG. 6.

It should be understood that the number of contacts for anodes per primary contact bar segment may be chosen according to the number of cathodes removed from the capping board during copper recovery. For example, if one cathode out of two (instead of one cathode out of three) is removed from the capping board, embodiments of the method may be adapted to maximize the number of contact bar segments with two contact regions for anodes and two contact regions for cathodes.

Optionally, the capping board may also include projecting anchor elements cooperating with corresponding cavities of the contact bar segments. Referring to FIG. 4, the capping board 2 may include a projecting anchor element 22 extending upwardly from the primary channel. The primary contact bar segment 12 may include a corresponding cavity 24 receiving the anchor element 22 so as to enhance stability of the contact bar segment 12 on the capping board 2. Referring to FIG. 5, the capping board 2 may be segmented into at least two capping board segments 2*a*, 2*b* which are maintained together with a primary contact bar segment 12 having two cavities 24 receiving an anchor element 22 from each capping board segment. The secondary contact bar segment (not shown in FIGS. 4 and 5) may include the same type of cavity to accommodate corresponding anchor elements of the capping board.

The contact bar segments located at extremities of the capping board may have a greater tendency to undergo loss of amperage. In another optional aspect, the method may include increasing or maximizing current density at extremities of the capping board and contact bar segment assembly by placing at the extremities contact bar segments having an increased number of contact regions for anodes and/or cathodes with respect to other regions of the capping board. Optionally, at least one primary contact bar segment including four contact regions for anodes may be placed at each extremity of the capping board. Further optionally, a contact bar segment including four contact regions for anodes or four contact regions for cathodes may be placed on a middle section of the capping board to enhance symmetrical current distribution.

Figure 7:
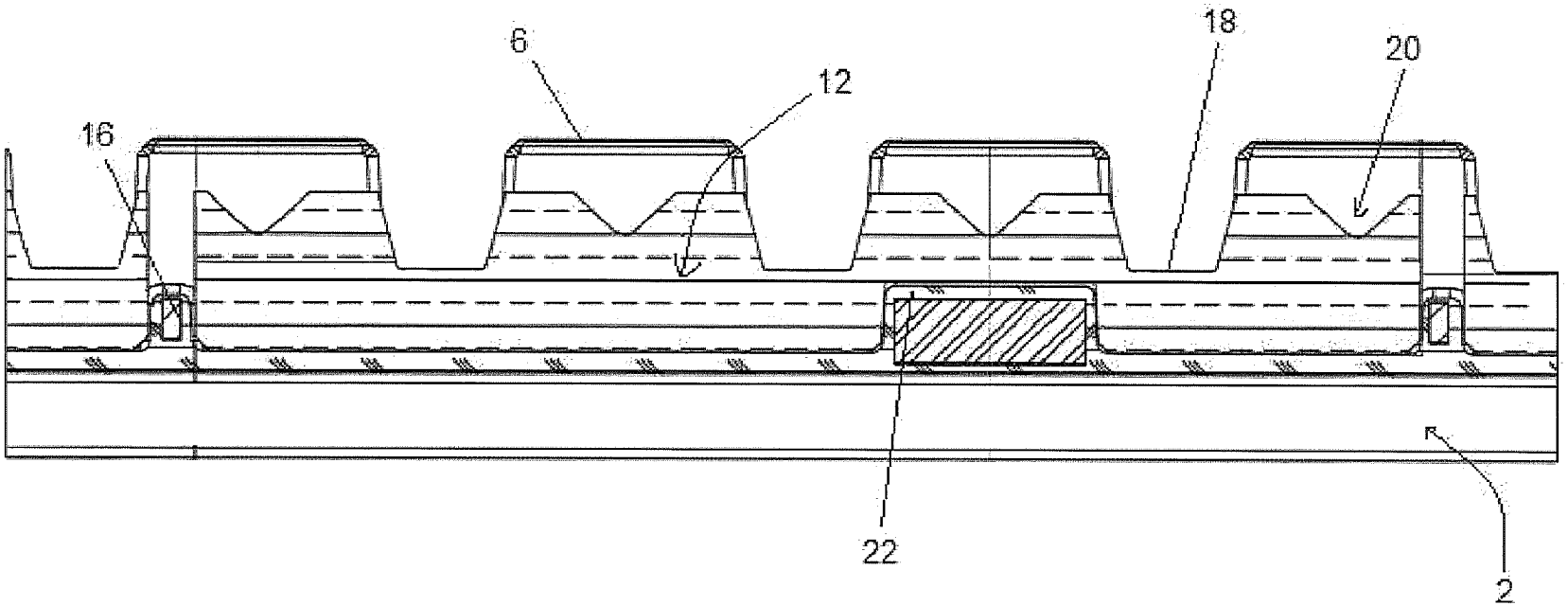
FIG. 7 is a cross-sectional side view of the capping board and primary contact bar segment of area C along line III of FIG. 1.

Referring to FIG. 7, the primary contact bar segment 12 located in a middle section of the capping board 2 (area C of FIG. 1) may include three depressions 18 for contacting anodes and four depressions 20 allowing four cathodes to contact the primary contact bar segment (not shown in FIG. 7). It should be understood that "middle section" means that there are an equal number of contact bar segments on either side of the contact bar segment located at the middle section.

Figure 8:
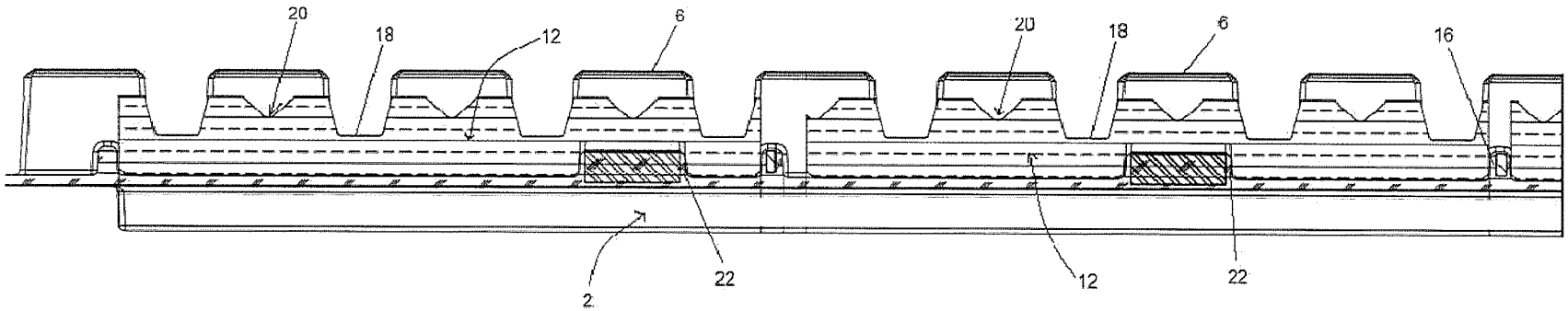
FIG. 8 is a cross-sectional side view of the capping board and primary contact bar segment of area D along line III of FIG. 1.

Referring to FIG. 8, the primary contact bar segments 12 located at extremities of the capping board 2 (area D of FIG. 1) may include four depressions 18 for contacting anodes. The depressions 20 may also allow three or four contacts of cathodes with the primary contact bar segments (not shown in FIG. 8, illustrated in FIG. 3).

It should be understood that the method of segmentation of the contact bar segments may vary according to the total number of anodes to be placed on the capping board. The number of contact regions for anodes per contact bar segment may vary to ensure current density homogeneity along the capping board according to the removal pattern of the cathodes (one over three, one over two, etc.) during copper (or other metal) electroplating or recovery.

Figure 9:
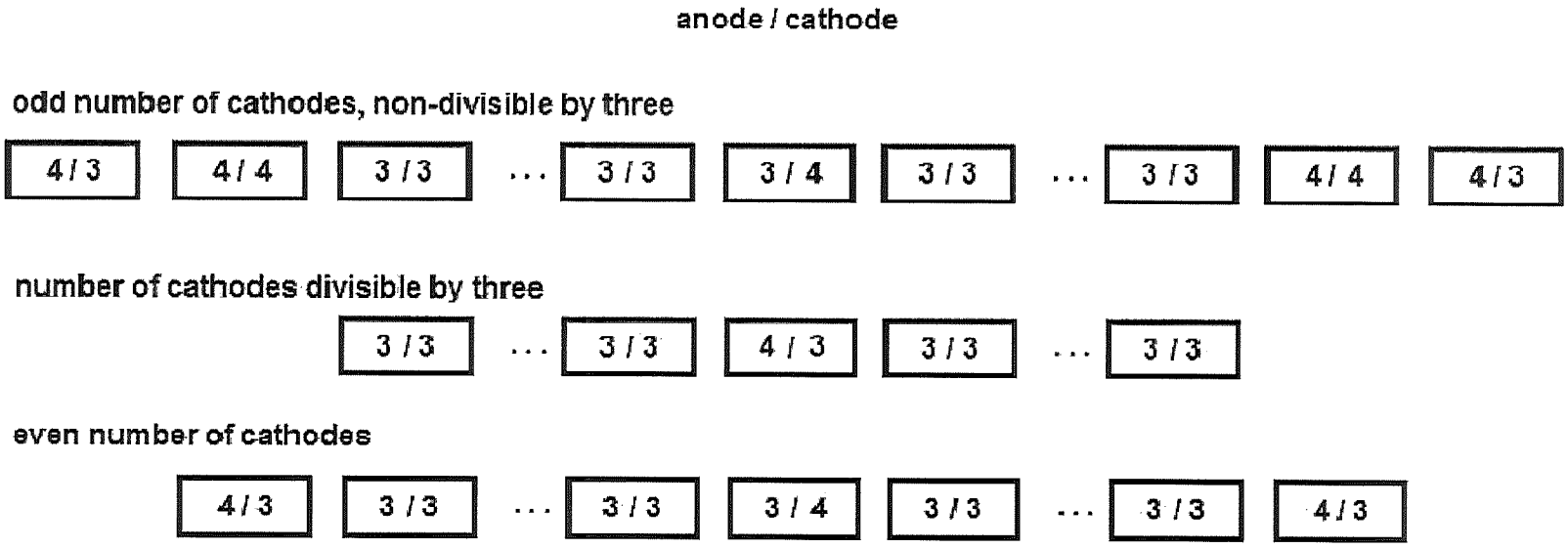
FIG. 9 is a block schematic representing three different contact bar segment and capping board assembly configurations according to optional embodiments of the present invention.

FIG. 9 illustrates various segmentation scenarios according to embodiments of the present method. While maximizing contact bar segments with three anode and cathode contacts, the positioning of contact bar segments may vary and the number of anode contacts on the middle section of the capping board and on the capping extremities may also vary. The number of contact bar segments and their configuration may be adapted to the length and configuration of the capping board and/or electrolytic cell. A contact bar segment may have three or four contact regions for anodes, and three or four contact regions for cathodes, including 4/3, 3/3, 3/4 and 4/4 configurations. For example, when the number of cathodes to be placed on the capping board is divisible by three, two types of primary contact bar segments may be used on the capping board: one with four contact regions for anodes in the middle and one with three contact regions for anodes and cathodes along the rest of the capping board. Two other scenarios with respectively two types of contact bar segments and three types of contact bar segments along the capping board are also represented, respectively for an even number of cathodes and an odd number of cathodes to be placed on the capping board.

It should be understood that the present invention is not limited to relate to a contact bar segment and capping board assembly having the configuration as illustrated in FIGS. 1 to 9. More generally, embodiments of the method and assembly may be adapted to any contact bar segment configuration having multiple contact regions for anodes and cathodes.

It should also be understood that the present invention is not limited to include primary and secondary contact bars and may be adapted to a capping board having a single central elongated channel receiving contact bar segments with contact regions for anodes and cathodes.

Figure 10:
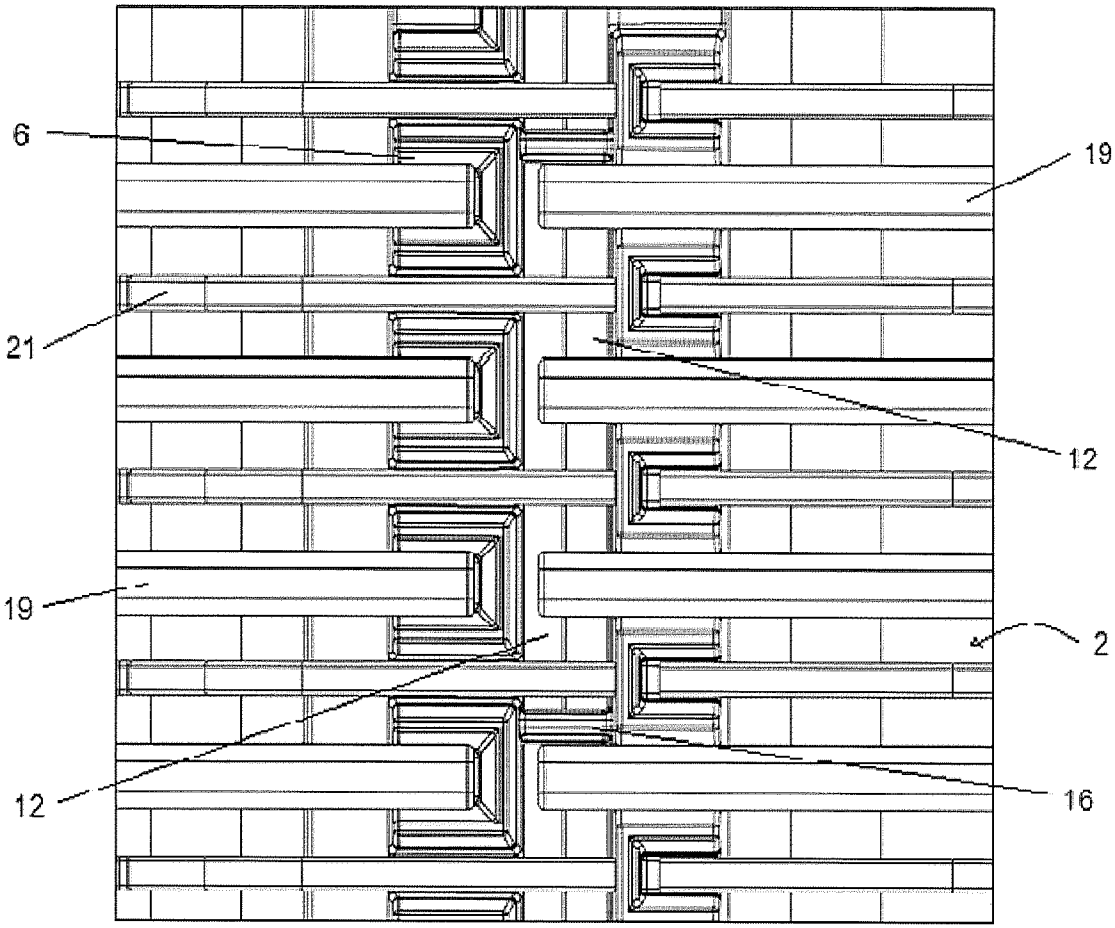
FIG. 10 is a top plan view of a portion of a capping board and contact bar assembly according to optional embodiments of the present invention.

According to an example embodiment, FIG. 10 illustrates a capping board and contact bar assembly including a single elongated channel for receiving contact bar segments 12 positioned all over the length of the capping board 2 for allowing connection of the hanging bars of the anodes 19 located in one electrolytic cell to the hanging bars of the cathodes 21 located in the adjacent electrolysis cell, via their hanging bars 28 that stay directly on the contact bar assembly 26.

Figure 11:
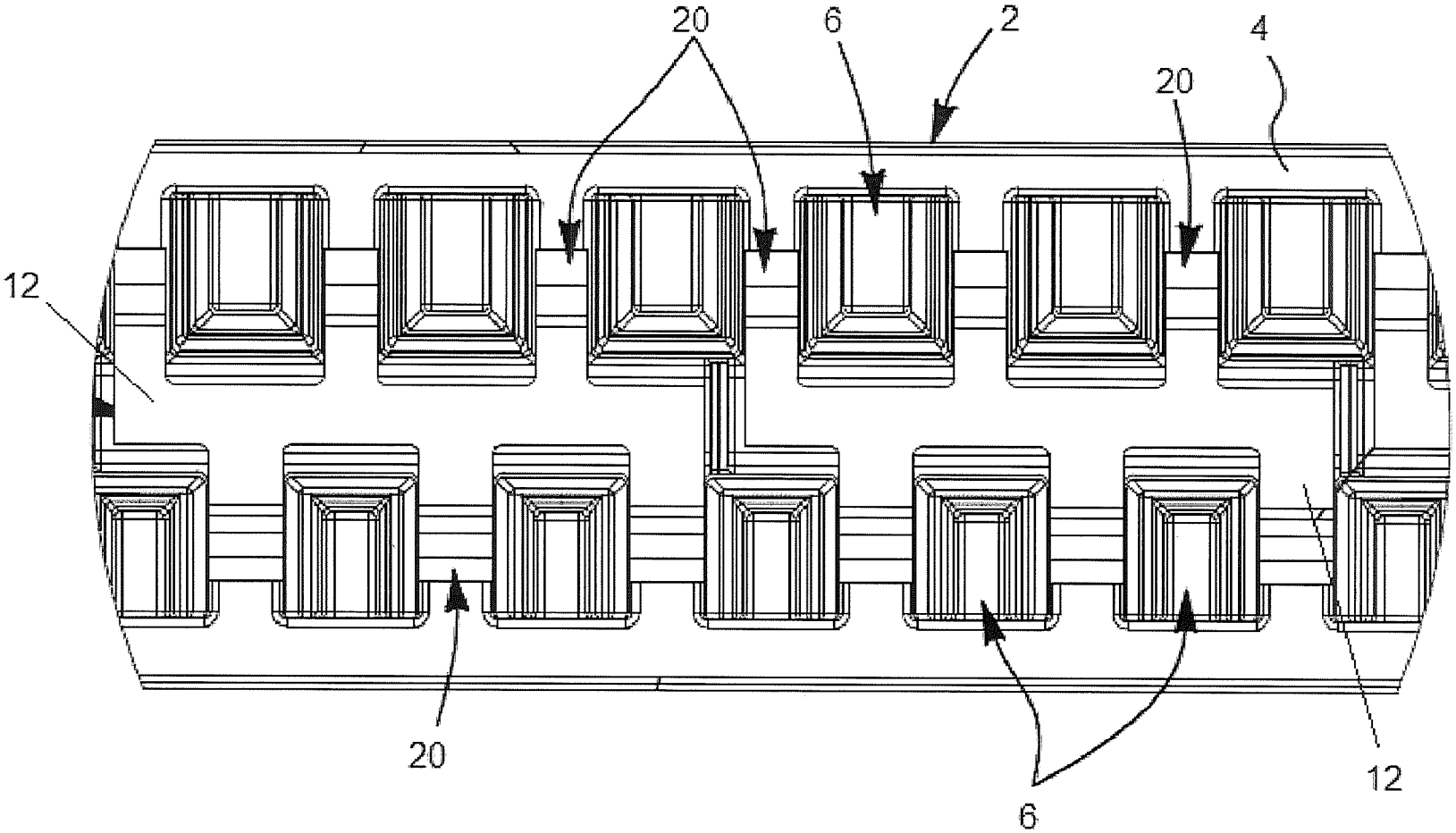
FIG. 11 is a top plan view of a portion of a capping board and contact bar segment assembly according to an optional embodiment of the present invention.
Figure 12:
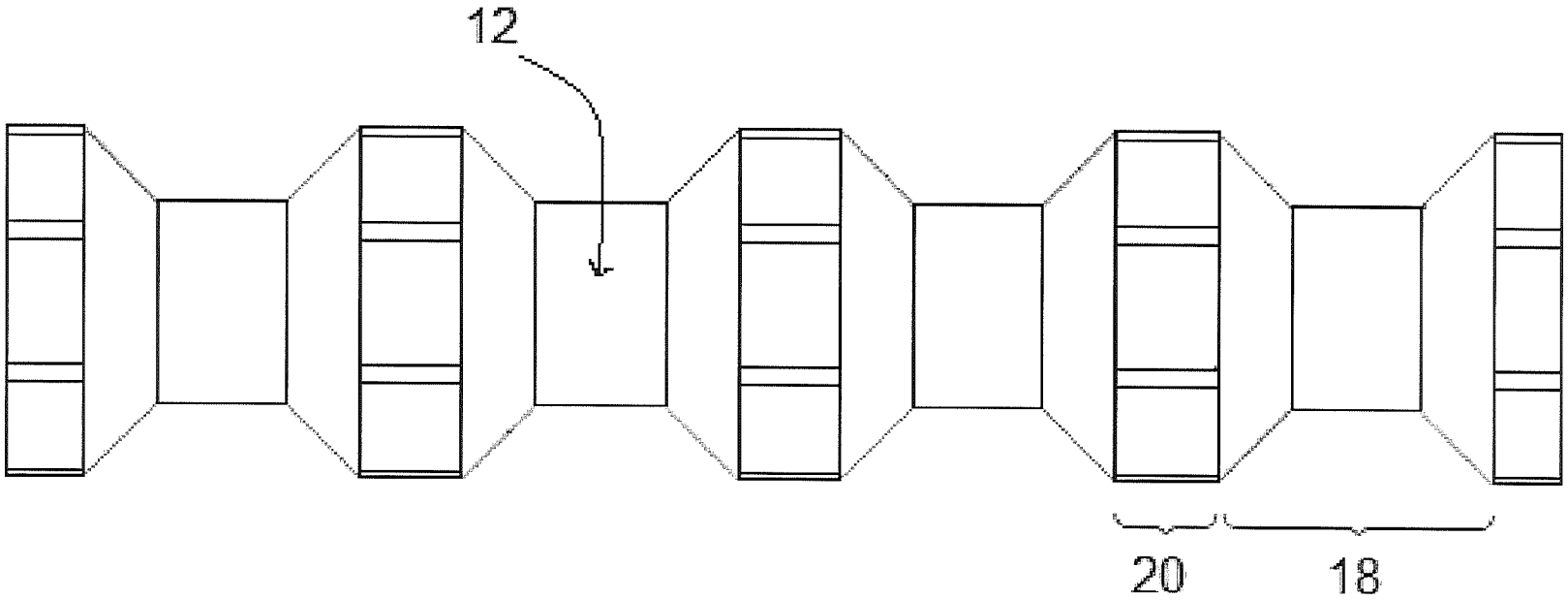
FIG. 12 is a side plan view of a contact bar segment having multiple-contact surfaces according to an optional embodiment of the present invention.

According to another example embodiment, FIG. 11 illustrates a capping board and contact bar assembly including a single elongated channel for receiving symmetrical contact bar segments. The contact bar segment includes contact regions for anodes and contact regions for cathodes, which numbers may vary according to the above-described embodiments of the present invention. According to another example embodiment, the present method of segmentation and positioning may be adapted to various configurations of contact bars, such as multi-contact bar segments having contact regions for cathodes with hexagonal sections as illustrated in FIG. 12.

Further enhancements may include providing a method for manufacturing and inventorying contact bar segments for use in one or more electrolytic cell, each having a predetermined number of anodes and cathodes. The method may include making a series of 3/3 contact bar segments, making a series of 4/4 contact bar segments, making a series of 3/4 contact bar segments, and making a series of 4/3 contact bar segments, so as to be coordinated with the pre-determined number of anodes and cathodes of each electrolytic cell.

Embodiments of the present invention also relates to various configurations of capping board and contact bar assembly obtained according to the above-mentioned positioning method.

The invention claimed is:

1. A method for enhancing current density homogeneity in contact bar segments along a capping board including:

providing the capping board;

providing a series of contact bar segments independently positionable on the capping board for providing alternating contact points for a pre-determined number of anodes and a pre-determined number of cathodes, wherein the series of contact bar segments includes:

a first sub-set of contact bar segments each being sized and configured to contact N number of anodes and N number of cathodes; and either a second sub-set of one or more contact bar segments each being sized and configured to contact N number of anodes and N+1 number of cathodes; or a second sub-set of one or more contact bar segments each being sized and configured to contact N+1 number of anodes and N number of cathodes, wherein N is an integer which is equal to at least three;

positioning a center contact bar segment of the second sub-set of one or more contact bar segments at a center of the capping board; and positioning the contact bar segments on the capping board with a symmetrical configuration with respect to the center contact bar segment.

2. The method according to claim 1, wherein each contact bar segment of the second sub-set is sized and configured to contact N number of anodes and N+1 number of cathodes, and wherein the series of contact bar segments includes a third sub-set of one or more contact bar segments, each being sized and configured to contact N+1 number of anodes and N number of cathodes, wherein the third sub-set of the one or more contact bar segments includes two end contact bar segments that are positionable at respective opposed extremities of the capping board.

3. The method according to claim 1, further comprising contacting the pre-determined number of anodes and cathodes with the contact bar segments.

4. The method according to claim 1, wherein the number N in the first and second sub-sets of contact bar segments is three.

5. The method according to claim 1, comprising positioning each contact bar segment of the second sub-set of contact bar segments on a middle section of the capping board.

6. The method according to claim 1, comprising increasing or maximizing the number of contact bar segments of the first sub-set to be provided according to the total number of cathodes to be placed on the capping board.

7. The method according to claim 1, wherein each contact bar segment of the second sub-set is sized and configured to contact N+1 number of anodes and N number of cathodes, and wherein two of the first sub-set of contact bar segments are end contact bar segments that are positionable at respective opposed extremities of the capping board.

8. The method of claim 2, comprising positioning each contact bar segment with increased number of contact regions for cathodes on a middle section of the capping board.

9. The method of claim 1, comprising positioning each contact bar segment with increased number of contact regions for anodes on a middle section of the capping board.

10. The method of claim 1, comprising increasing or maximizing the number of contact bar segments from the first sub-set that have N contact regions for anodes and N contact regions for cathodes according to the total number of cathodes to be placed on the capping board.

* * * * *